US007748063B2

(12) United States Patent
Chen et al.

(10) Patent No.: US 7,748,063 B2
(45) Date of Patent: Jul. 6, 2010

(54) BABY SOOTHING DEVICE

(75) Inventors: Hong-Bo Chen, Taipei (TW); Chih-Wei Wang, Taipei (TW)

(73) Assignee: Excellerate Enterprise Co., Ltd., Songshan District, Taipei (TW)

( * ) Notice: Subject to any disclaimer, the term of this patent is extended or adjusted under 35 U.S.C. 154(b) by 1 day.

(21) Appl. No.: 12/270,831

(22) Filed: Nov. 13, 2008

(65) Prior Publication Data

US 2009/0126105 A1 May 21, 2009

Related U.S. Application Data

(60) Provisional application No. 60/988,394, filed on Nov. 15, 2007.

(51) Int. Cl.
*A47D 9/02* (2006.01)
*A47D 13/10* (2006.01)

(52) U.S. Cl. ..... 5/109; 297/260.2

(58) Field of Classification Search ..... 5/109, 5/104; 297/260.2

See application file for complete search history.

(56) References Cited

U.S. PATENT DOCUMENTS

| | | | | |
|---|---|---|---|---|
| 756,230 | A * | 4/1904 | Goodard | 5/127 |
| 4,765,212 | A * | 8/1988 | Julius | 82/152 |
| 5,097,545 | A | 3/1992 | Hooi | |
| 5,288,283 | A | 2/1994 | Meeker | |
| 5,624,321 | A | 4/1997 | Snyder | |
| 5,729,844 | A | 3/1998 | Kerstetter | |
| 2003/0062748 | A1 | 4/2003 | Julien | |
| 2007/0262627 | A1 * | 11/2007 | Clapper et al. | 297/260.2 |
| 2009/0126105 | A1 * | 5/2009 | Chen et al. | 5/109 |

FOREIGN PATENT DOCUMENTS

| | | |
|---|---|---|
| GB | 2 087 225 A | 5/1982 |
| GB | 2 181 946 A | 5/1987 |
| GB | 2 218 572 A | 11/1989 |
| GB | 2 246 068 A | 1/1992 |
| GB | 2 386 551 A | 9/2003 |

* cited by examiner

*Primary Examiner*—Robert G Santos
(74) *Attorney, Agent, or Firm*—Winston Hsu

(57) ABSTRACT

A baby soothing device includes a holding structure, a supporting frame, a sliding shaft, and a driving device. The holding structure is used for holding a baby. The supporting frame is used for supporting the holding structure on a surface. The sliding shaft has an end connected to the holding structure. The driving device is disposed between the sliding shaft and the supporting frame. The driving device is used for driving the sliding shaft to move upward and downward relative to the supporting frame.

14 Claims, 8 Drawing Sheets

BABY SOOTHING DEVICE

CROSS REFERENCE TO RELATED APPLICATIONS

This application claims the benefit of U.S. Provisional Application No. 60/988,394, filed on Nov. 15, 2007 and entitled "Soothing device" the contents of which are incorporated herein by reference.

BACKGROUND OF THE INVENTION

1. Field of the Invention

The present invention relates to a baby soothing device, and more specifically, to a baby soothing device capable of moving upward and downward.

2. Description of the Prior Art

A common baby cradle can swing leftward and rightward or forward and backward via a swing mechanism. Thus, a baby care giver may push the baby cradle to swing back and forth for helping the baby fall asleep. However, the said swing mechanism may limit direction of the motion the baby cradle. As mentioned above, the baby cradle in the prior art may simply swing leftward and rightward or forward and backward. If the baby cradle needs to be moved upward and downward, it is necessary for the baby care giver to push the baby cradle with his hands or for a baby disposed therein to jump upward and downward on the swing device. In other words, the baby cradles capable of moving upward and downward are not available so far.

SUMMARY OF THE INVENTION

The present invention provides a baby soothing device comprising a holding structure for holding a baby; a supporting frame for supporting the holding structure on a surface; a sliding shaft having an end connected to the holding structure; and a driving device disposed between the sliding shaft and the supporting frame, the driving device being used for driving the sliding shaft to move upward and downward relative to the supporting frame.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
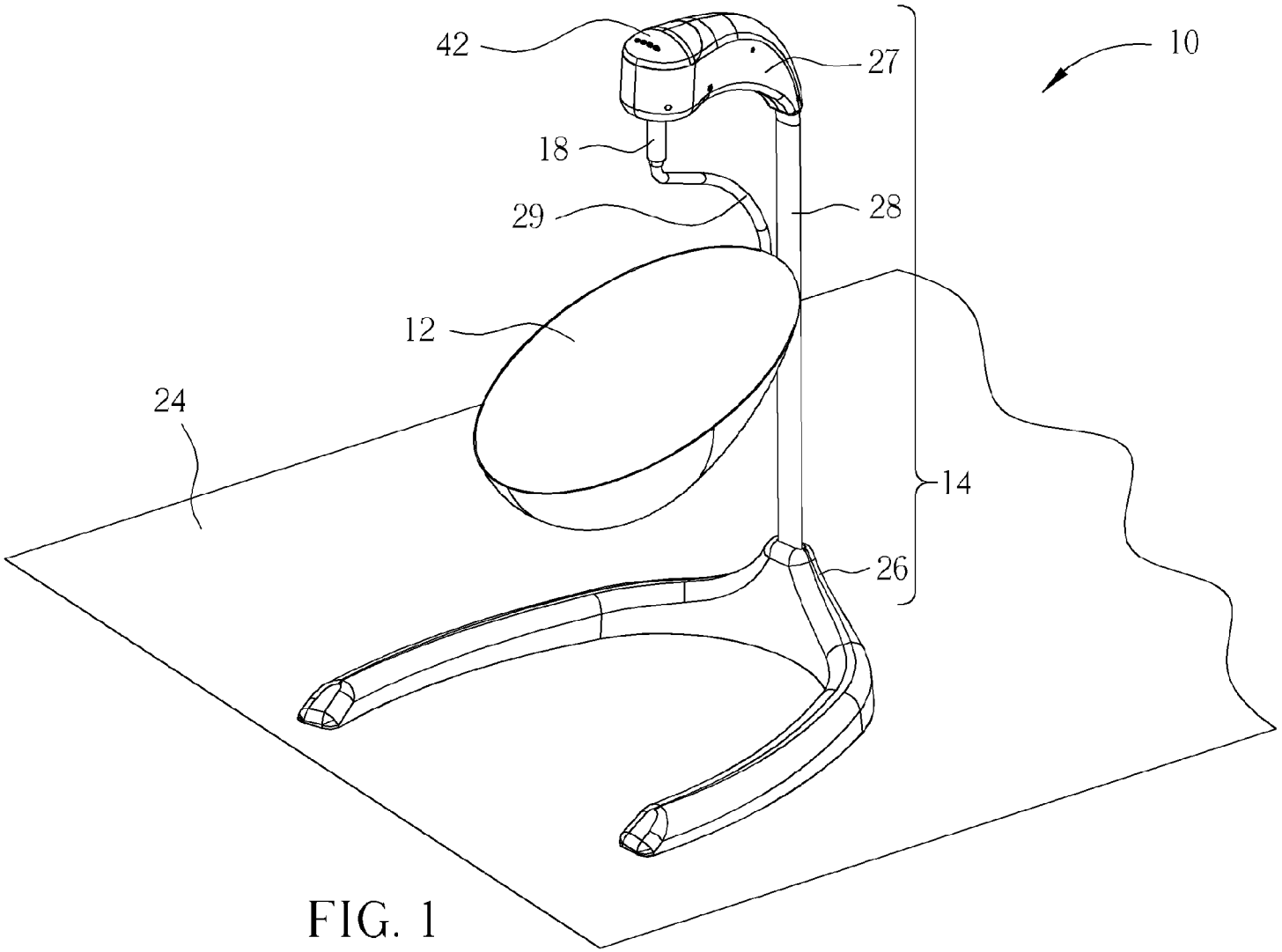
FIG. 1 is an assembly diagram of a baby soothing device according to the present invention.
Figure 2:
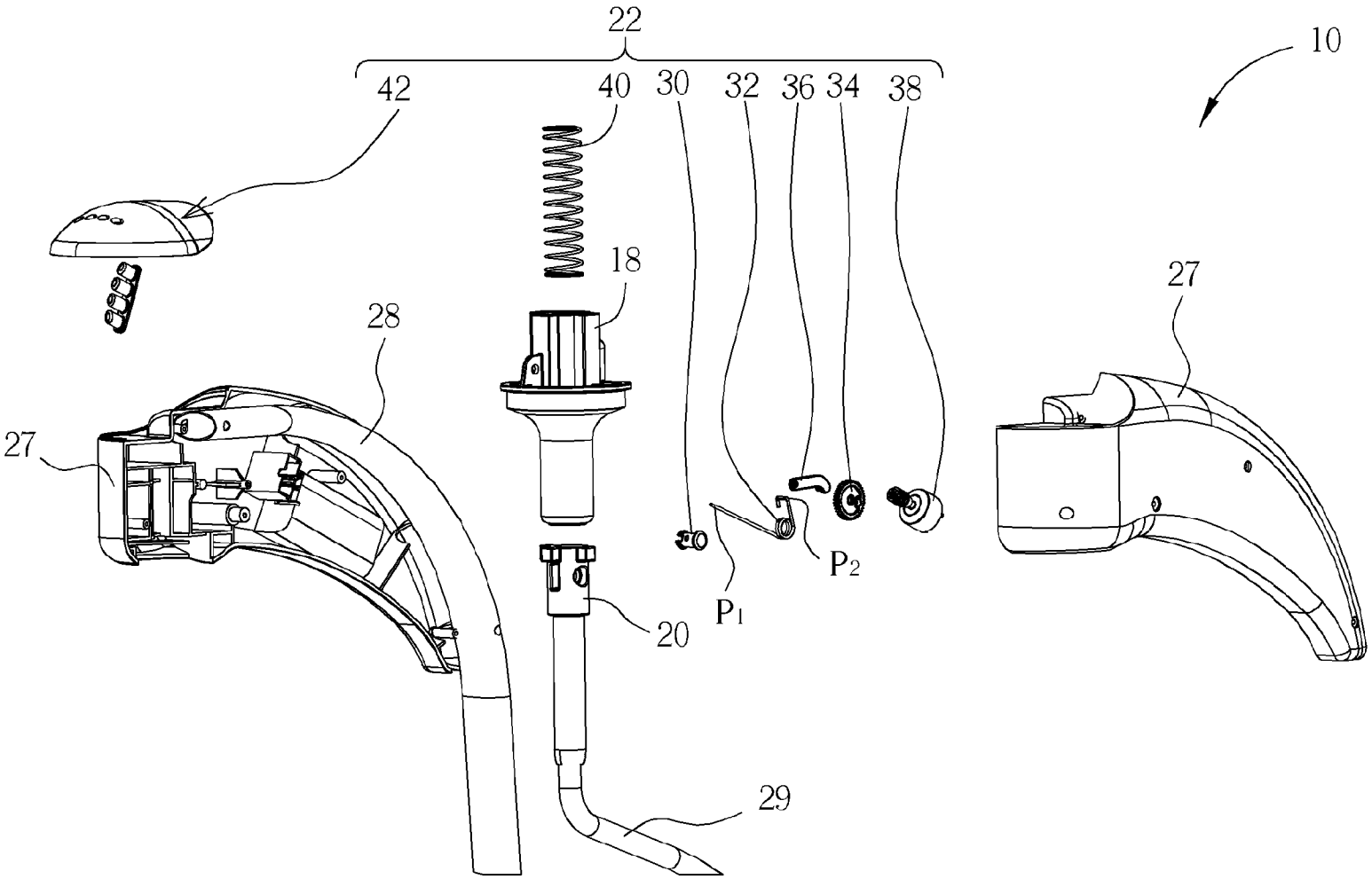
FIG. 2 is a partial exploded diagram of the baby soothing device in FIG. 1.

Please refer to FIG. 1 and FIG. 2. FIG. 1 is an assembly diagram of a baby soothing device 10 according to the present invention. FIG. 2 is a partial exploded diagram of the baby soothing device 10 in FIG. 1. The baby soothing device 10 comprises a holding structure 12, a supporting frame 14, a positioning sheath 18, a sliding shaft 20, and a driving device 22. The holding structure 12 is used for holding a baby. The holding structure 12 may be a baby cradle, or a baby seat, or a baby swing. The supporting frame 14 is used for supporting the holding structure 12 on a plane 24 shown in FIG. 1. The plane 24 may be a surface for disposal of the baby soothing device 10, such as a floor. As shown in FIG. 1, the supporting frame 14 comprises a supporting base 26, a connecting structure 27, and a supporting rod 28. The supporting base 26 may be a U-shaped base or a common supporting mechanism. The supporting rod 28 is connected to the supporting base 26 and the connecting structure 27. The positioning sheath 18 is connected to the connecting structure 27, and the sliding shaft 20 is installed in the positioning sheath 18 in a movable manner. The sliding shaft 20 has an arm 29 (as shown in FIG. 1). The arm 29 is connected between an end of the sliding shaft 20 and the holding structure 12. Thus, the holding structure 12 may be hung above the plane 24 via the arm 29 at a distance. The driving device 22 is disposed in the connecting structure 27 and connected to the sliding shaft 20. The driving device 22 is used for driving the sliding shaft 20 to slide along the positioning sheath 18 so as to move the holding structure 12 upward and downward relative to the plane 24.

Figure 3:
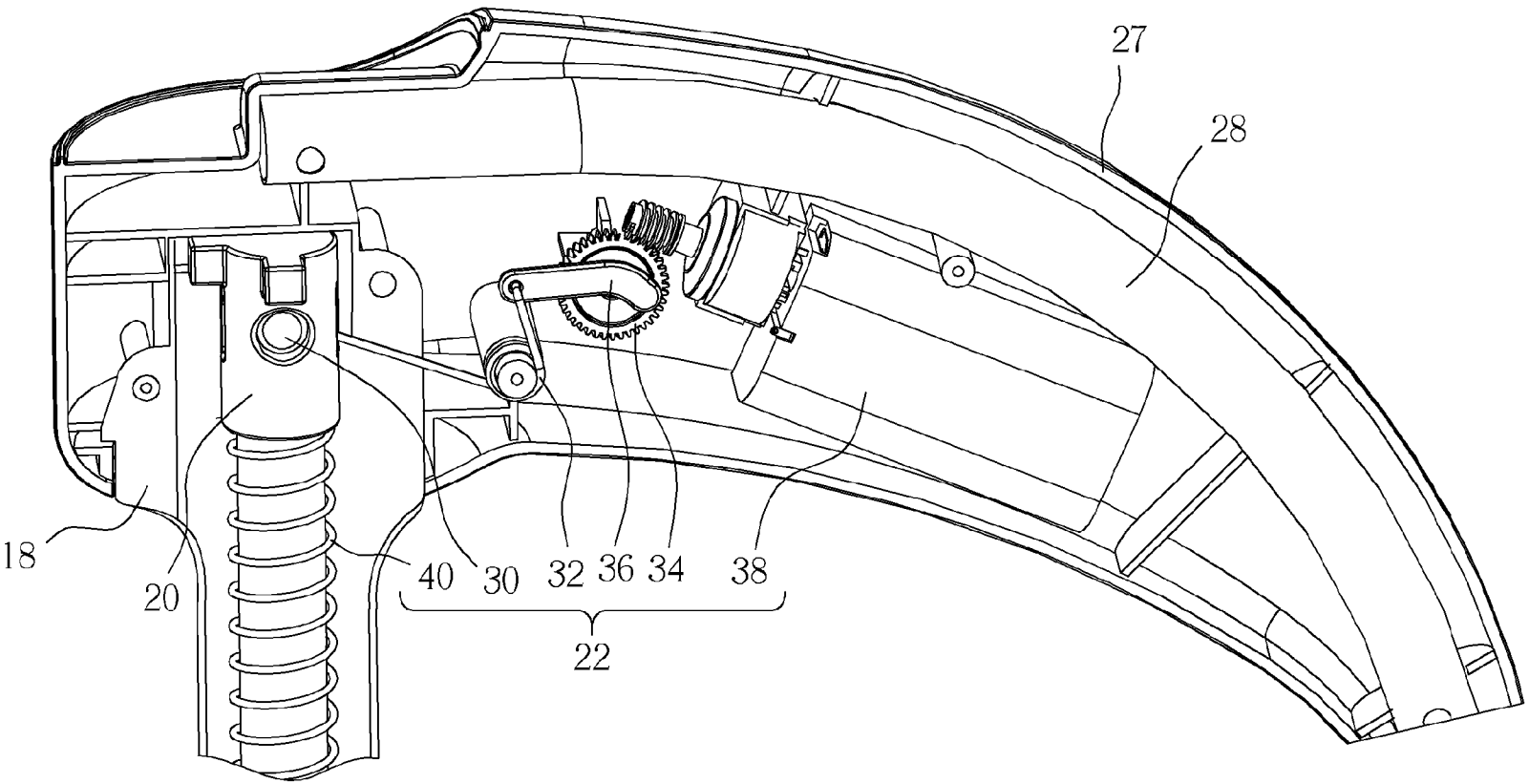
FIG. 3 is an internal diagram of the connecting structure in FIG. 2.
Figure 4:
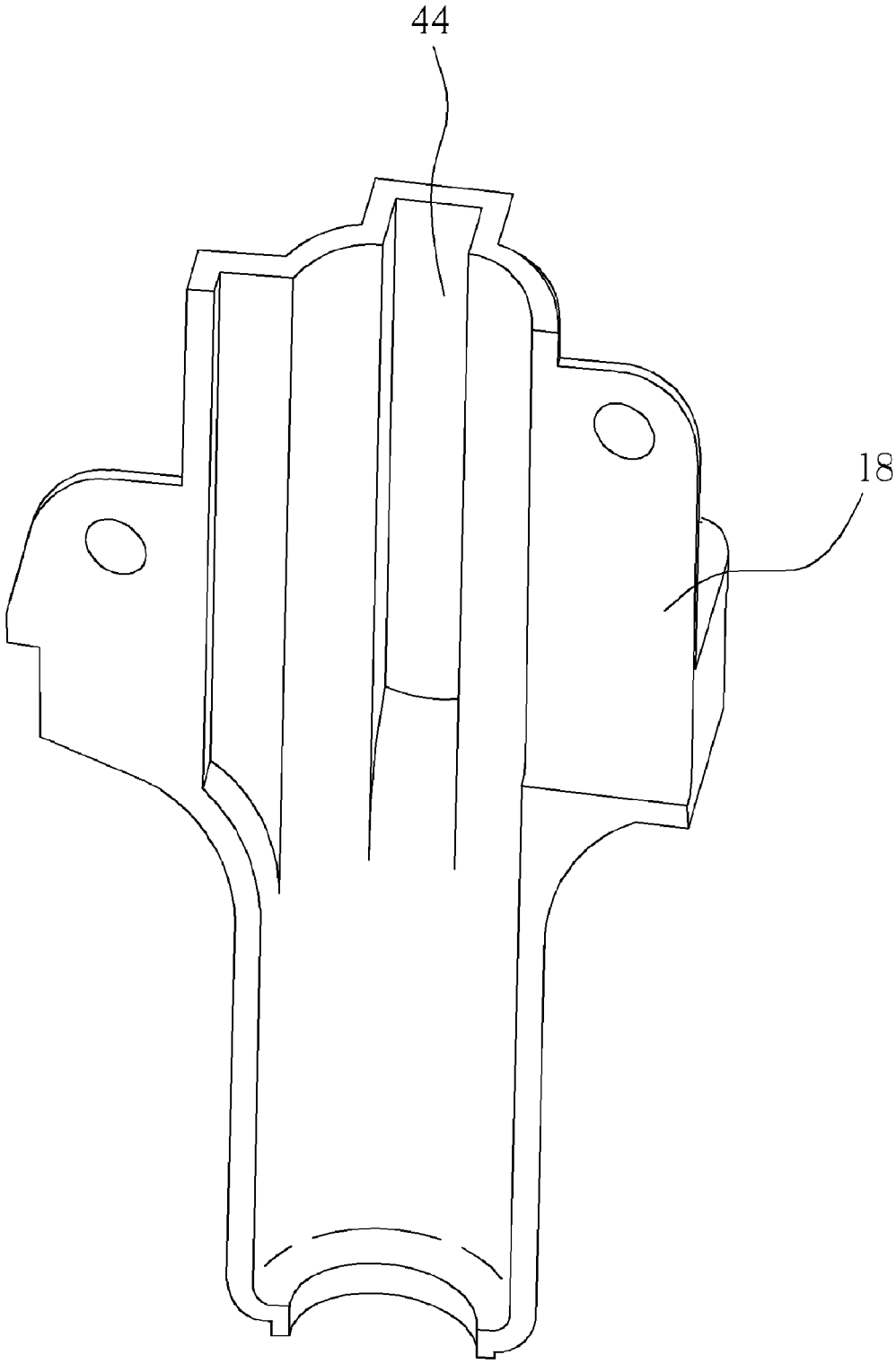
FIG. 4 is an enlarged diagram of the internal structure of the positioning sheath in FIG. 2.
Figure 5:
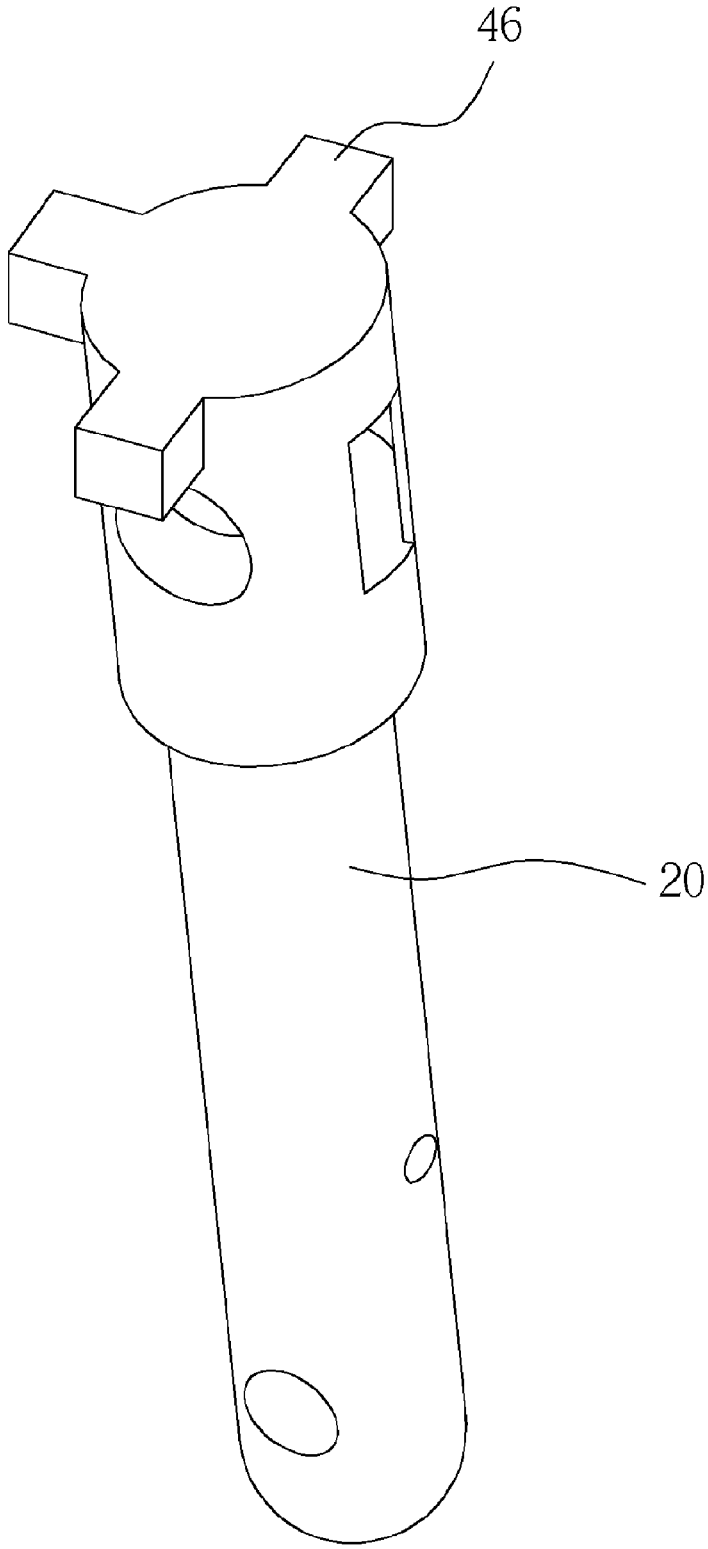
FIG. 5 is a partial enlarged diagram of the sliding shaft in FIG. 2.

More detailed description for the driving device 22 is provided as follows. Please refer to FIG. 1, FIG. 2, and FIG. 3. FIG. 3 is an internal diagram of the connecting structure 27 in FIG. 2. As shown in FIG. 3, the driving device 22 comprises a rotating part 30, a torsion spring 32, a driven gear 34, a driving rod 36, a motor 38, an elastic part 40, and a control panel 42 (shown in FIG. 1 and FIG. 2). The rotating part 30 is disposed through the sliding shaft 20 in a rotatable manner. The torsion spring 32 is installed in the connecting structure 27. A first end $P_1$ of the torsion spring 32 (shown in FIG. 2) is passed through and connected to the rotating part 30. The driven gear 34 is installed in the connecting structure 27 in a rotatable manner. The driving rod 36 is connected between a second end $P_2$ (shown in FIG. 2) of the torsion spring 32 and the driven gear 34. The motor 38 is installed in the connecting structure 27 and engaged with the driven gear 34. The motor 38 can drive the driven gear 34 to move the driving rod 36 so that the torsion spring 32 may drive the sliding shaft 20 to slide along the positioning sheath 18 with the movement of the driving rod 36. The elastic part 40 sheathes the sliding shaft 20 and abuts against the sliding shaft 20 and the positioning sheath 18 at two ends respectively for providing the sliding shaft an elastic force to move up and down. The elastic part 40 may be a spring or an object with elasticity. The control panel 42 is disposed on the connecting structure 27 and electrically connected to the motor 38. The control panel 42 is used for controlling starting of the motor 38 or for controlling the moving condition of the holding structure 12 by adjusting the motor 38. Next, please refer to FIG. 4 and FIG. 5. FIG. 4 is an enlarged diagram of the internal structure of the positioning sheath 18. FIG. 5 is a partial enlarged diagram of the sliding shaft 20. As shown in FIG. 4 and FIG. 5, a guiding slot 44, which may be a linear guiding slot, is formed in the positioning sheath 18. The sliding shaft 20 has a protruding portion 46 on the periphery. The sliding shaft 20 may slide along the guiding slot 44 via the cooperation of the protruding portion 46 and the guiding slot 44. It should be noted that the number of the protruding portion 46 may be three, as shown in FIG. 5, or more, and the number of the guiding slot 44 in the positioning sheath 18 may be increased correspondingly. In such a manner, the sliding shaft 20 may slide along the positioning sheath 18 more firmly. In addition, disposal of the positioning sheath 18 and the connecting structure 27 may also not be limited to the said design. For example, the positioning sheath 18 may also be formed integrally with the connecting structure 27 for reducing the related manufacturing cost.

Figure 6:
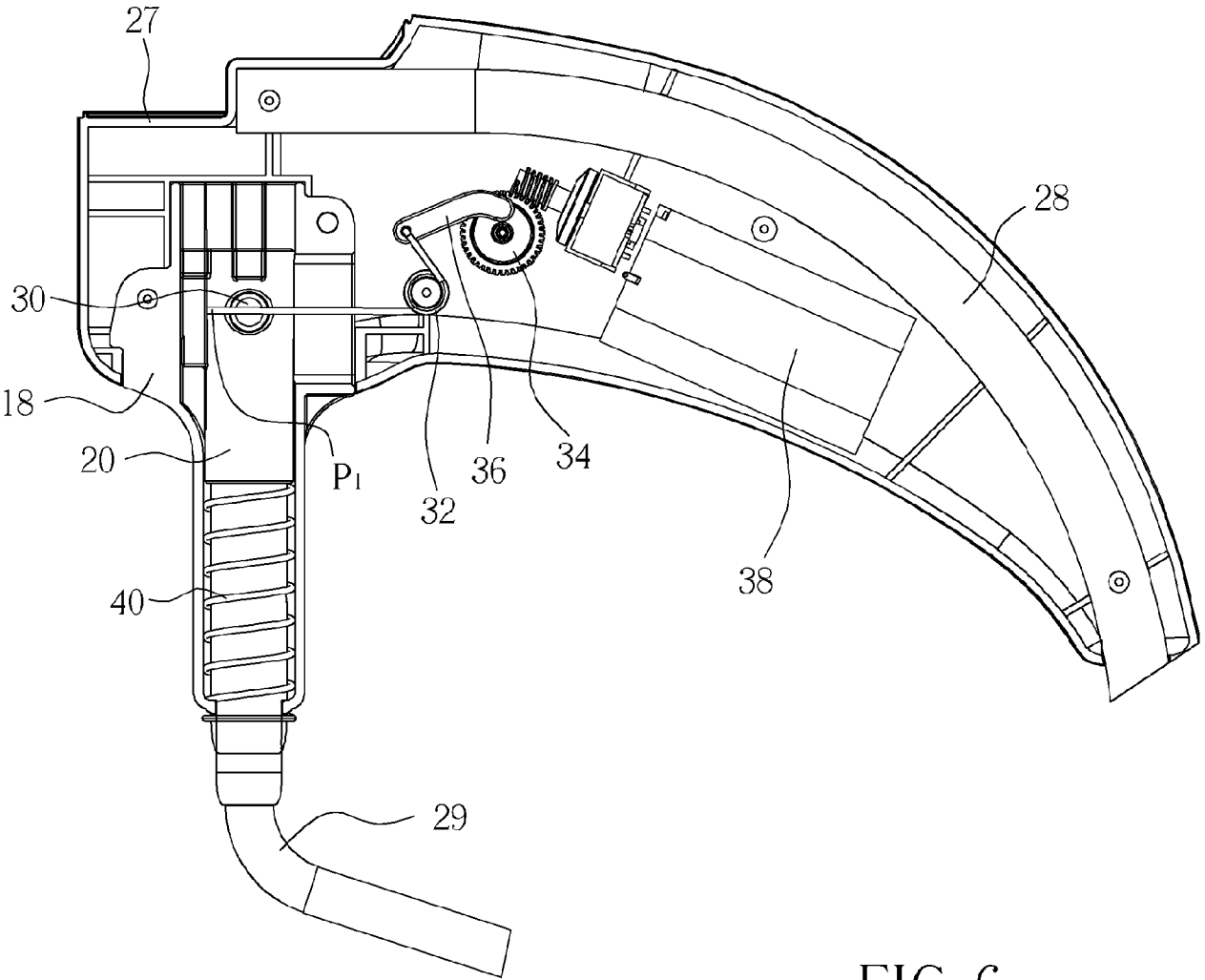
FIG. 6 is an internal lateral diagram of the connecting structure in FIG. 3.
Figure 7:
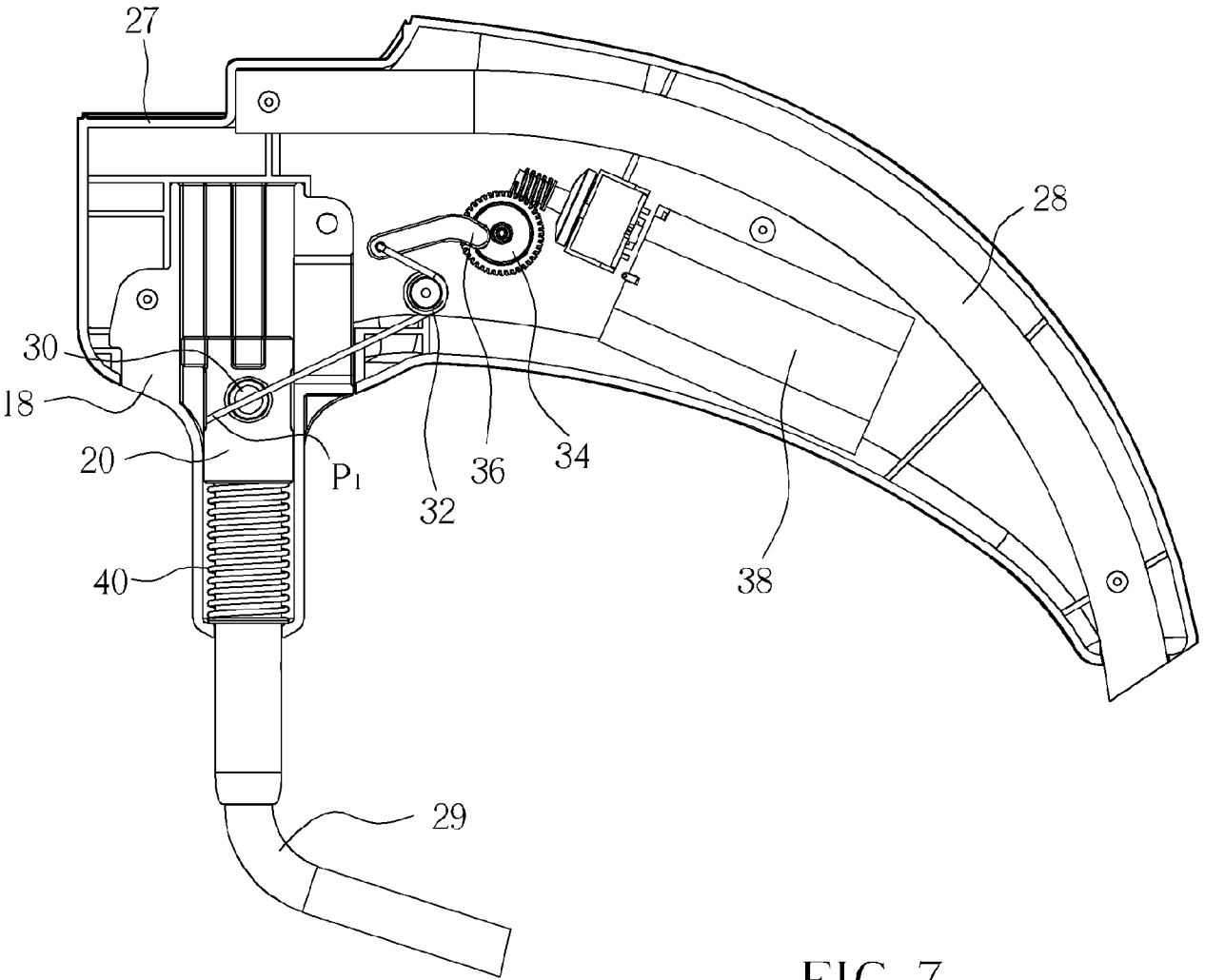
FIG. 7 is a diagram of the torsion spring in FIG. 6 driving the sliding shaft to move downward.
Figure 8:
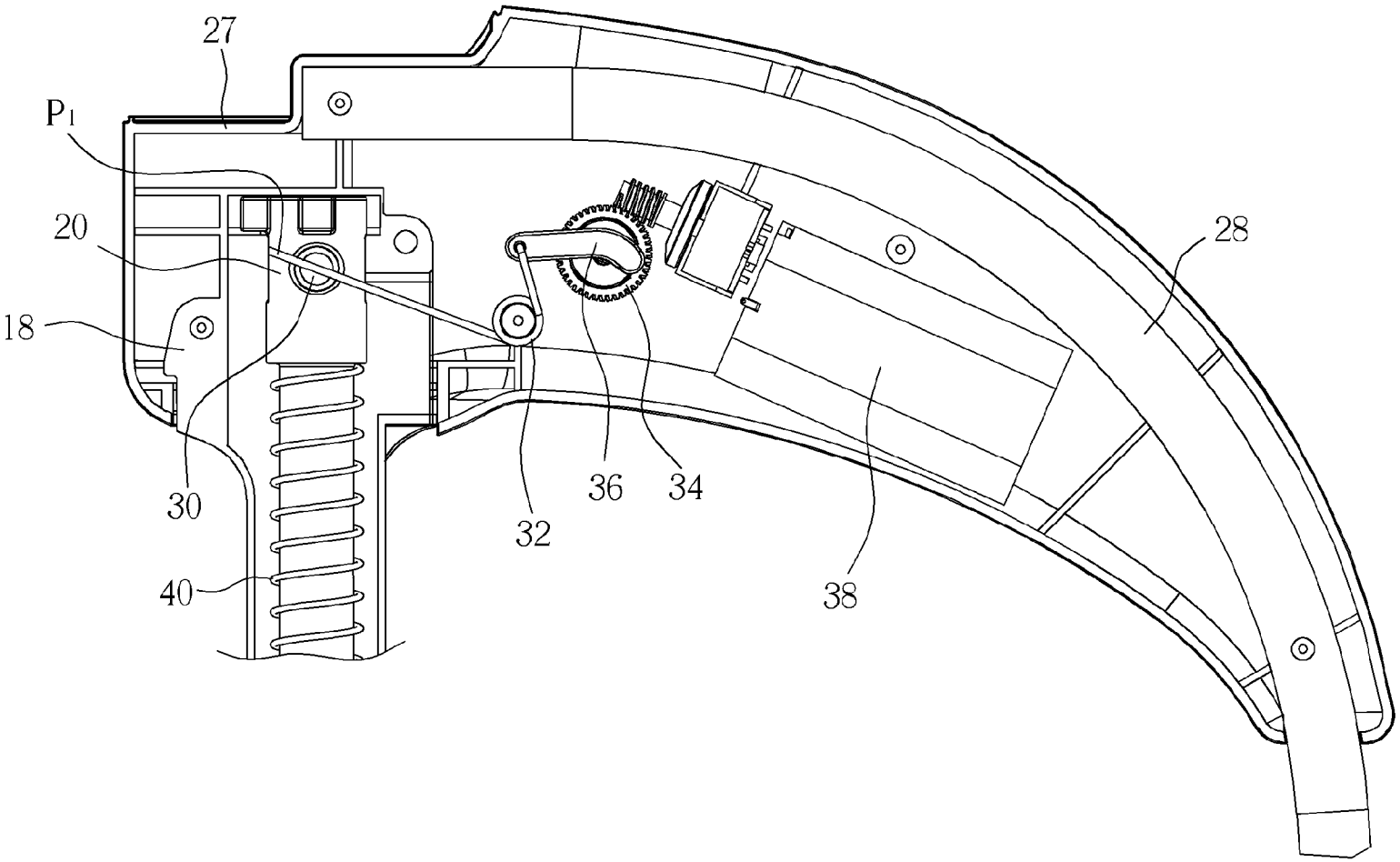
FIG. 8 is a diagram of the torsion spring in FIG. 6 driving the sliding shaft to move upward.

More detailed description for the baby soothing device 10 is provided as follows. Please refer to FIG. 1 and FIG. 2. When a user switches on the control panel 42 of the baby soothing device 10 to actuate the motor 38 in order to move the holding device 12 upward and downward, the motor 38 may first drive the driven gear 34 to rotate. When the driven gear 34 is rotated counterclockwise, the driving rod 36, which is connected with the second end $P_2$, may move the first end $P_1$ of the torsion spring 32 from a position shown in FIG. 6 to another position shown in FIG. 7 with rotation of the driven gear 34. At the same time, the first end $P_1$ of the torsion spring 32 may also push the sliding shaft 20 from a position shown in FIG. 6 downward to another position shown in FIG. 7 (at this time, the elastic part 40 is in a compressed state) so that the holding structure 12 may be moved downward correspondingly. Subsequently, the said rotating part 30 may be utilized to make the linkage of the first end $P_1$ of the torsion spring 32 and the sliding shaft 20 smoother since the relation of the first end $P_1$ of the torsion spring 32 and the sliding shaft 20 may vary with the location of the sliding shaft 20 in the positioning sheath 18. Next, when the driving rod 36 is rotated counterclockwise from the position shown in FIG. 7 to a position shown in FIG. 8 with the continuous rotation of the driven gear 34, the first end $P_1$ of the torsion spring 32 may be moved from the position shown in FIG. 7 to a position shown in FIG. 8 correspondingly. At this time, the sliding shaft 20 may be pushed from the position shown in FIG. 7 upward to a position shown in FIG. 8 (the elastic part 40 is changed from the said compressed state to an extended state) while the rotating part 30 is rotated relative to the sliding shaft 20 by the position changing of the first end $P_1$ of the torsion spring 32. As a result, the holding structure 12 may be moved upward correspondingly by the sliding shaft 20. In such a manner, the torsion spring 32 may keep pushing the sliding shaft 20 to slide upward and downward along the positioning sheath 18 so that the holding structure 12 may be moved upward and downward continuously. In addition, in the process of the sliding shaft 20 sliding upward and downward, the force provided from the elastic part 40 may not only reduce the driving force that the motor 38 needs to provide, but also decrease the torque that torsion spring 32 receives. Therefore, life of components in the baby soothing device 10 may be prolonged.

In the embodiments based on the present invention, the method for driving the sliding shaft 20 is not limited to the said method. For example, structural design of the driving device 22 may be changed from the said active linkage mechanism (i.e. assembly of the said control panel, the motor, the driven gear, the driving rod, the torsion spring, and the rotating part) to a simple elastic part design. That is to say, instead of utilizing the motor 38 to drive the sliding shaft 20, the driving device 22 may only utilize the elastic part 40 (such as a spring) to sheath the sliding shaft 20 and to abut against the sliding shaft 20 and the positioning sheath 18 at two ends respectively. In such a manner, when the user wants to make the baby soothing device 10 move upward and downward, the user simply needs to pull the arm 29 downward (at this time, the elastic part 40 is in a compressed state), and then releases the arm 29. Such the sliding shaft 20 starts to slide along the positioning sheath 18 back and forth by the elastic force provided from the elastic part 40 so that the holding structure 12 may move upward and downward correspondingly. In other words, the mechanism design of the baby soothing device 10 is changed from a motorized design to a manual design. As for which design is utilized, it depends on practical application needs. In addition, besides the said spring driving mechanism, the driving device 22 may also utilize other driving mechanisms, such as a pneumatic mechanism, a hydraulic mechanism, a magnetic mechanism, and so on. Furthermore, in said manual design embodiment, structural design of the guiding slot 44 may be not limited to said linear design. For example, the guiding slot 44 may also be a helix-shaped guiding slot. Thus, the motion track of the sliding shaft 20 in the positioning sheath 18 may be changed from the said linear track to a helical track via engagement of the protruding portion 46 of the sliding shaft 20 and the guiding slot 44 of the positioning sheath 18. That is to say, the holding structure 12 may also rotate relative to the connecting structure 27 while the holding structure 12 is moving upward and downward.

Compared with the prior art, in which a swing mechanism is utilized to make a baby cradle swing forward and backward or leftward and rightward, the baby soothing device provided by the present invention utilizes an active linkage mechanism (e.g. assembly of the said control panel, the motor, the driven gear, the driving rod, the torsion spring, and the rotating part) or a manual spring mechanism to drive a holding structure for holding a baby to move upward and downward. Thus, the baby soothing device of the present invention may have more variety in direction of motion.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A baby soothing device comprising:

a holding structure for holding a baby;

a supporting frame for supporting the holding structure on a surface;

a sliding shaft having an end connected to the holding structure; and a driving device disposed between the sliding shaft and the supporting frame, the driving device comprising:

a rotating part rotatably disposed through the sliding shaft;

a torsion spring installed in the supporting frame, a first end of the torsion spring being passed through the rotating part for driving the rotating part to rotate relative to the sliding shaft;

a driven gear rotatably installed in the supporting frame;

a driving rod connected to a second end of the torsion spring and the driven gear; and a motor installed in the supporting frame and engaged with the driven gear, for driving the driven gear to move the driving rod so as to make the torsion spring drive the sliding shaft to move upward and downward relative to the supporting frame.

2. The baby soothing device of claim 1, wherein the supporting frame comprises a connecting structure for connecting the sliding shaft, the baby soothing device further comprises a positioning sheath disposed inside the connecting structure, and the sliding shaft is slidably connected to the positioning sheath.

3. The baby soothing device of claim 2, wherein a guiding slot is formed in the positioning sheath, and the sliding shaft has a protruding portion for guiding the sliding shaft along the guiding slot.

4. The baby soothing device of claim 3, wherein the guiding slot is a helix-shaped guiding slot.

5. The baby soothing device of claim 3, wherein the guiding slot is a linear guiding slot.

6. The baby soothing device of claim 2, wherein the positioning sheath is formed integrally with the connecting structure.

7. The baby soothing device of claim 1, wherein the sliding shaft comprises an arm at the end of the sliding shaft, and the arm is connected between the sliding shaft and the holding structure.

8. The baby soothing device of claim 2, wherein the supporting frame further comprises:

a supporting base; and a supporting rod connected to the supporting base and the connecting structure.

9. The baby soothing device of claim 8, wherein the supporting base is a U-shaped base.

10. The baby soothing device of claim 2 further comprising:

an elastic part sheathing the sliding shaft, two ends of the elastic part abutting against the sliding shaft and the connecting structure respectively for providing the sliding shaft an elastic force.

11. The baby soothing device of claim 10, wherein the elastic part is a spring.

12. The baby soothing device of claim 2, wherein the driving device further comprises a control panel disposed on the connecting structure and electrically connected to the motor, the control panel being used for controlling the motor.

13. The baby soothing device of claim 1, wherein the holding structure is a baby cradle.

14. The baby soothing device of claim 1, wherein the holding structure is a baby seat.

* * * * *